US005992844A

United States Patent [19]

Dillinger et al.

[11] Patent Number: 5,992,844

[45] Date of Patent: Nov. 30, 1999

[54] SHEET DECELERATION DEVICE USING PULTRUDED BRISTLE BRUSHES

[75] Inventors: Daniel R. Dillinger, Park Falls; Andrew J. Ponomarenko, Phillips, both of Wis.

[73] Assignee: Marquip, Inc., Phillips, Wis.

[21] Appl. No.: 08/994,604

[22] Filed: Dec. 19, 1997

[51] Int. Cl.[6] ..... B65H 29/68

[52] U.S. Cl. ..... 271/182; 271/202

[58] Field of Search ..... 271/182, 202, 271/220

[56] References Cited

U.S. PATENT DOCUMENTS 3,998,141 12/1976 Hsiue .
4,133,523 1/1979 Berthelot .
4,667,953 5/1987 Hirakawa et al. .
5,139,862 8/1992 Swift et al. ..... 428/294
5,396,044 3/1995 Orlowski et al. ..... 219/121.66
5,415,389 5/1995 Adami ..... 271/182
5,436,696 7/1995 Orlowski et al. ..... 355/200
5,599,012 2/1997 Rebeaud .

*Primary Examiner*—W. Grant Skaggs
*Attorney, Agent, or Firm*—Andrus, Sceales, Starke & Sawall

[57] ABSTRACT

The bristles for brushes used in the deceleration section of a sheet handling system are made of a pultruded construction utilizing a high strength fiber core and high wear resin binder to provide bristles which will not acquire a set from bending and exhibit extremely long wear life. Pultruded fibers of various cross sectional shapes and constructions may be utilized to tune the brushes to a particular sheet handling application.

7 Claims, 4 Drawing Sheets

SHEET DECELERATION DEVICE USING PULTRUDED BRISTLE BRUSHES

BACKGROUND OF THE INVENTION

The present invention pertains to a sheet feeding or delivering device and, more particularly, to an improved brush assembly for use in the deceleration section of a sheet conveying system.

Sheet conveying and handling systems often include a deceleration section where serially aligned sheets leaving an upstream conveyor are compressed and shingled on a slower moving downstream receiving conveyor. One common type of decelerating or shingling conveyor utilizes a vacuum belt which serves to capture the faster moving sheets from the upstream conveyor and hold them onto the vacuum belt of the slower moving deceleration conveyor. Depending upon sheet length, speed, and the material from which the sheets are made, a vacuum deceleration conveyor may alone be insufficient to provide adequate sheet deceleration and to maintain control of the sheet.

Various devices to assist the transfer of sheets onto a vacuum deceleration conveyor are known in the art. One common device is an arrangement of one or more brushes, each of which extends across the conveyor perpendicular to the direction of sheet travel and positioned to bring a line of flexible brush bristles into bearing contact with the upper surfaces of the sheets as they are delivered into the vacuum conveyor section. The brush or brushes assist in providing a frictional decelerating force to the sheets and also to press the sheets downwardly onto the vacuum conveyor because of the inherent resilience of the bristles. Such brush assemblies often include means for adjusting the angle and amount of bristle contact with the sheets to selectively vary the force imposed by the brushes.

Typical prior art sheet deceleration devices including brushes are shown in U.S. Pat. Nos. 3,998,141, 4,133,523, 4,667,953, and 5,599,012. Plastic fiber bristles are often used in such brushes, but little attention has been paid in the prior art to the particular selection of plastic resins from which such bristles are made. Bristles or strips made of polyurethane, nylon, neoprene and other common plastics are known, However, a characteristic common to all of these materials is that, in use and under load, whether constant or varying, prior art plastic bristles wear rapidly from contact with abrasive paper sheets and quickly take a permanent set reflecting the bend to which they are subjected in use. Both the reduction in bristle length because of wear and the effective change in bristle position because of a permanent set in the bristles change the performance of the brushes and eventually require readjustment of the brush positioning system or replacement of the brush.

U.S. Pat. No. 5,139,862 discloses electrically conductive flexible pultruded fibers which are used to make a brush-like contact for an electrical switch. No use of these fibers in a brush assembly for a sheet handling system is described or suggested.

SUMMARY OF THE INVENTION

In accordance with the present invention, the prior art problems of rapid bristle wear and permanent bristle deformation or set in brushes used in sheet handling systems is obviated by the use of pultruded fibers of certain selected kinds. The invention is particularly adapted for use in a sheet handling system to assist in serially decelerating sheets which are being conveyed in a line onto a conveyor operating at a speed less than that of the line. The system includes a series of laterally aligned parallel bristles which are attached at one end to a common holder. A mounting device supports the holder over the conveyor with the free ends of the bristles extending in a generally downward direction and operable to cause the free ends of the bristles to bear downwardly against the sheets with a force sufficient to bend the bristles. The bristles have a pultruded construction which substantially resists the formation of a permanent set over a specified minimum bristle wear life.

The bristles may be circular in cross section and in such case may have a length to diameter ratio in the range of 200–300. The bristles may also be rectangular in cross section and, preferably, are mounted in the holder with the longer cross sectional dimensions laterally disposed.

The bristles are cut from a continuous fiber pultrusion which fiber preferably has a fiberglass core and a thermosetting resin coating. The resin coating may comprise a polyester resin. The mounting device is preferably adjustable to vary the downward forces imposed on the sheets by the bristles.

DETAILED DESCRIPTION OF THE PREFERRED EMBODIMENTS

Figure 1:
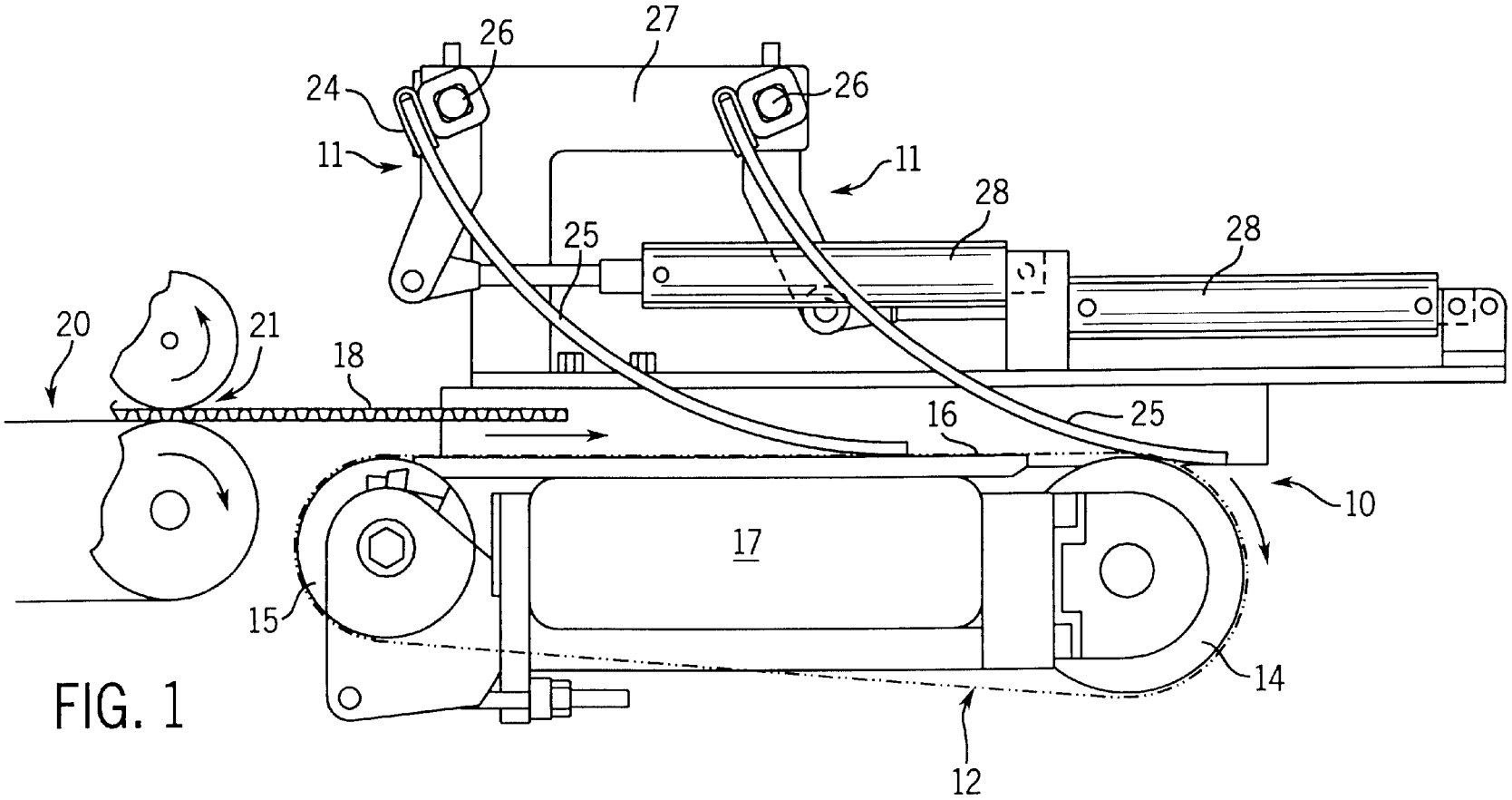
FIG. 1 is a side elevation view of a vacuum decelerating conveyor utilizing deceleration brushes with bristles of the subject invention disposed in their operative position.
Figure 2:
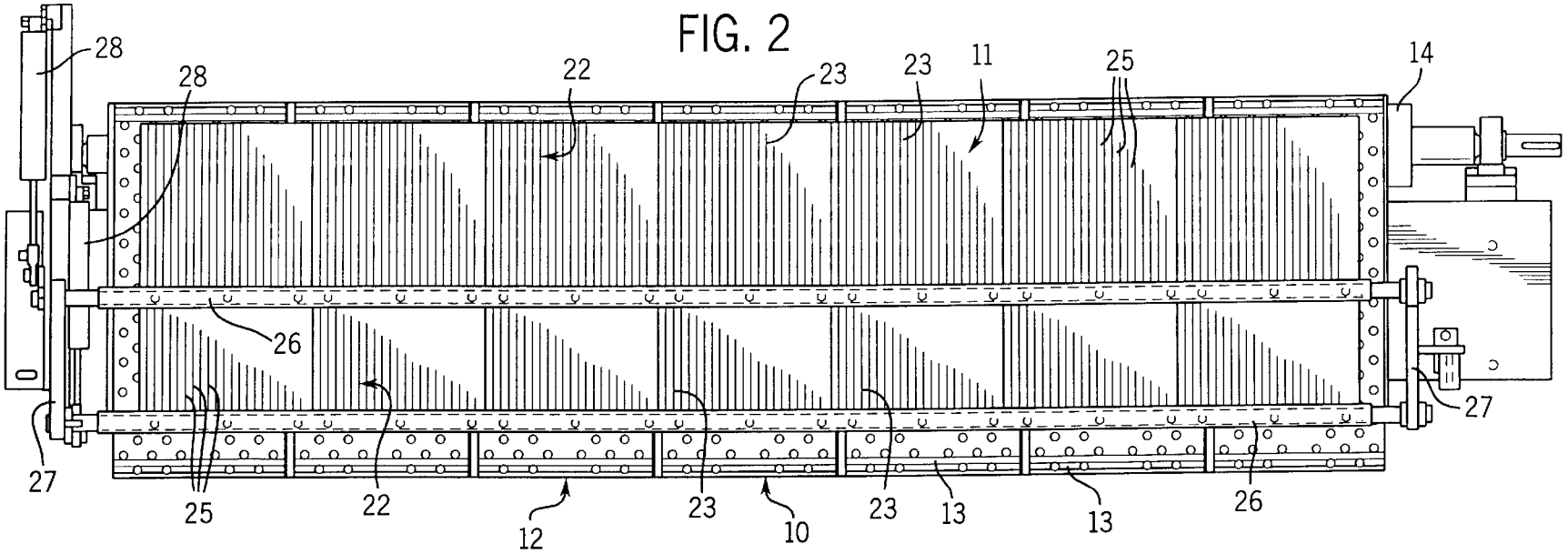
FIG. 2 is a top plan view of the decelerating conveyor shown in FIG. 1.
Figure 3:
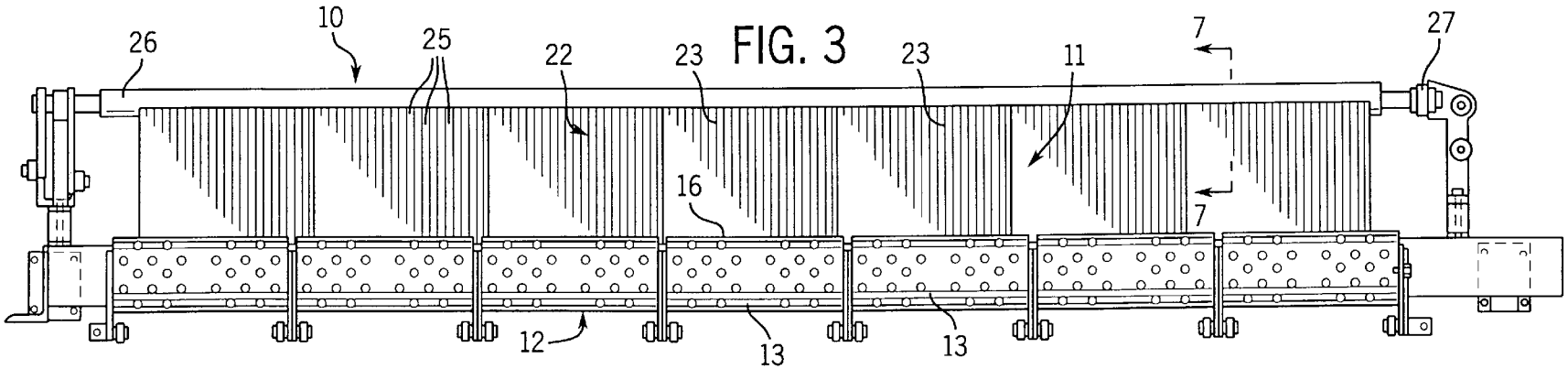
FIG. 3 is a vertical elevation of the decelerating conveyor shown in FIGS. 1 and 2 viewed in the downstream direction.
Figure 4:
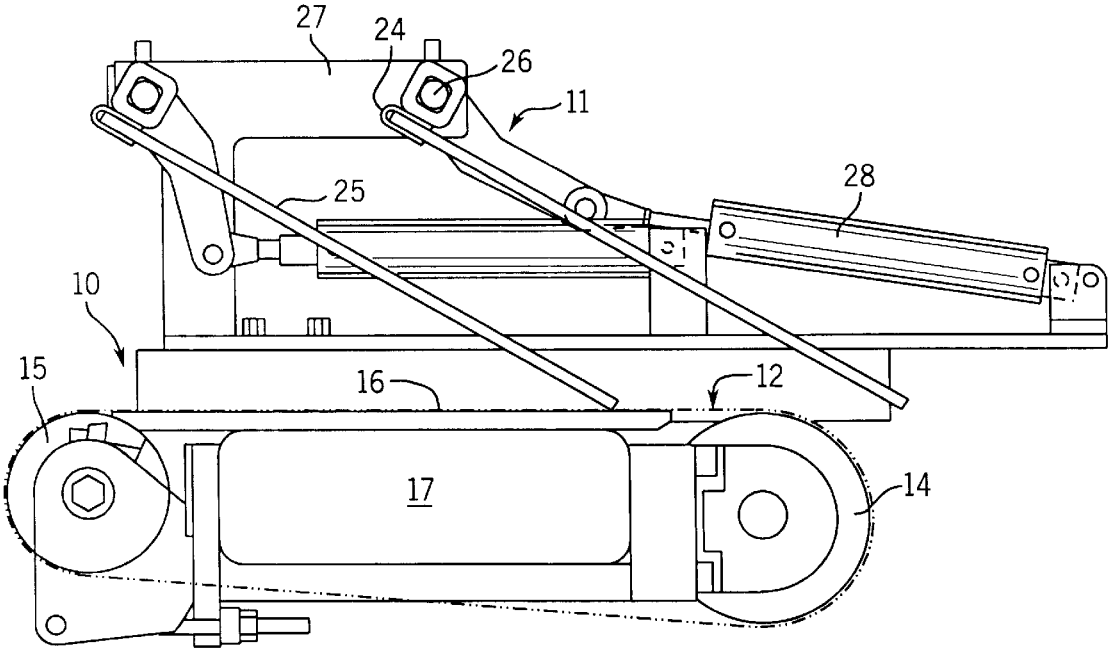
FIG. 4 is a side elevation similar to FIG. 1 showing the brushes moved to an inoperative position.

A sheet deceleration system includes a vacuum conveyor 10 over which are suspended two substantially identical brush assemblies 11 of the present invention. The vacuum conveyor 10 includes a driven apertured belt 12 comprising a series of laterally adjacent belt sections 13. The belt sections operate around a common downstream driven head pulley 14 and a common upstream tail pulley 15. The upper conveying run 16 of the belt is supported on a vacuum plenum 17. A vacuum applied by the plenum 17 is transmitted through the conveying run 16 of the apertured belt 12 causing a paper or paperboard sheet 18 to be drawn down onto the conveying run and held thereon to move at vacuum belt speed.

Typically, the sheets 18 are delivered to the vacuum conveyor 10 from an upstream conveyor 20, on which the sheets are serially arranged and, usually, in closely spaced relation. Because the vacuum conveyor 10 is used to decelerate the stream of sheets, the line of sheets must be compressed on the vacuum conveyor and the result is an overlapping or shingling of the sheets, all in a known manner. As is also typical in the prior art, the exit nip 21 of the upstream conveyor 20 is elevated above the conveying run 16 of the vacuum conveyor 10. Thus, sheets delivered to the vacuum conveyor drop and are pulled down onto the vacuum belt, allowing the lead edge of the next following sheet (which is still traveling at the higher speed of the upstream conveyor 20) to overlap the trailing edge of the sheet captured on the vacuum conveyor without interference or obstruction.

Figure 7:
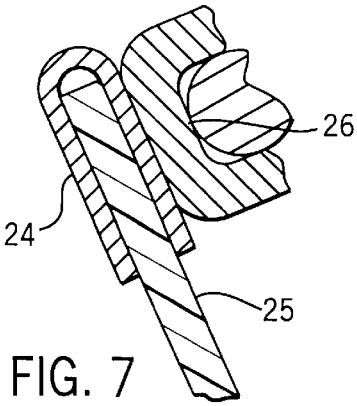
FIG. 7 is an enlarged partial sectional view taken on line 7—7 of FIG. 3.

The shingling process is assisted by the long bristled brushes 22 carried by the brush assembly 11. The brush 22 for each brush assembly comprises a number of laterally aligned brush sections 23 which may conveniently correspond in number to the belt sections 13. Each brush section 23 includes a holder 24 to which a row of laterally aligned bristles is attached by their common upper ends. The holders 24 are mounted in alignment on a brush support shaft 26 which spans the vacuum conveyor 10 in the cross machine direction between opposite lateral shaft brackets 27. Referring to FIG. 7, the holder 24 may conveniently comprise a sheet metal strip bent into a narrow U-shape defining a slot into which the bristles are inserted and held with a suitable adhesive, preferably an epoxy resin. The bristles may be inserted in side-by-side abutting relation or spaced apart, as may be desired for the particular intended application. A brush section 23 made with a continuous array of bristles disposed in side-by-side abutting relation may be customized for a particular application by breaking off selected bristles at the edge of the holder 24. The number and spacing of bristles so removed may be selectively varied and, as a result, the stiffness of the brush may be selectively varied. The holders 24 may be attached to the support shaft 26 with machine screws or any other suitable attachment means. The bristles 25 are longer than the vertical distance between the support shaft 26 and the conveying run 16 of the vacuum conveyor, such that the bristles are held in a slightly bent orientation in engagement with the conveying run 16 of the vacuum conveyor. The holders are also oriented such that the bristles extend in the downstream direction.

As a sheet 18 passes through the nip 21 of the upstream conveyor, the leading edge engages the brushes 22 in the upstreammost brush holder 24 and is deflected downwardly. As soon as the trailing edge of the sheet leaves the nip 21, the brushes also impart a frictional drag to the sheet to begin slowing it and simultaneously directing it downward into contact with the conveying run 16 of the apertured vacuum belt 12. The brushes assist in decelerating sheets and deflecting the same downwardly such that the sheets are brought more effectively under control of the vacuum conveyor and in a manner which clears the decelerating sheet from the path of the next following sheet.

Each of the brush support shafts 26 is rotatable on its axis and, under the influence of a pneumatic actuator 28, is rotatable to cause the bristles of the attached brush sections to provide a selectively variable downward force. The selected position of the brushes also results in the imposition of more or less bend in the bristles. In any event, however, the operative position of the brushes always results in the bristles being bent to some extent and, with prior art plastic bristles of any of the various materials used, the bristles will take a set, typically long before the bristles are worn to the point of requiring replacement. When the bristles acquire a set, the load profiles change and such change cannot be accurately predicted. As a result, consistent performance of the deceleration section becomes increasing problematic.

Bristles 25 made in accordance with the present invention have been found to resist taking a permanent set over a wear life which has also been substantially extended. The bristles are made from pultruded fibers which may be formed in round, rectangular, or other cross sectional shapes, with a rectangular cross section being presently preferable. Pultruded fibers are well known in the art, but the unique application of such fibers in holddown brushes 22 has resulted in substantially improved and unexpectedly enhanced performance. Referring to the detailed views of FIGS. 5 and 6, both the round section bristle 30 and the rectangular section bristle 31 comprise a similar pultruded construction in which one or more strands of a fiber 32 are impregnated with and encased in a plastic resin 33 in a continuous pultrusion process of a type known in the art. The bristles 25 of the present invention are preferably made with a core 32 comprising fiberglass threads or rovings 34 and a thermosetting polyester resin binder 35.

Round section bristles 30 having a diameter of 0.055 inch (1.4 mm) have been found to work well in bristle lengths up to about 16 to 17 inches (about 400 to 430 mm). However, bristle fiber diameters may be varied considerably, as well as the lengths thereof, while retaining all of the benefits of extreme resistance to permanent set and wear. The average content of the fiberglass rovings 34 in the round section bristles 30 may be about 40% by volume.

Figure 5:
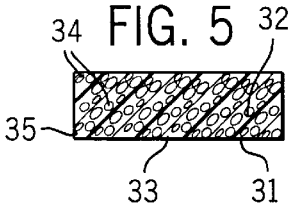
FIGS. 5 and 6 are greatly enlarged sectional views showing bristles of alternate construction.
Figure 6:
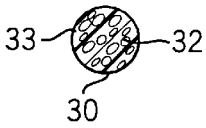

The rectangular bristle section 31 of FIG. 5 may be formed from the same materials as the round section. However, the rectangular section fiber may be pultruded with a larger number of multiple fiber rovings 34. One particularly suitable rectangular section bristle 31 has a section which is 0.060 inch thick and 3/16 inch wide (about 1.5×4.8 mm). The volume of fiberglass rovings 34 in the rectangular section bristle 31 may be about 45% by volume. When utilizing rectangular section bristles 31, they are mounted on the brush holder 24 with the longer cross sectional dimension oriented in the cross machine direction such that the bristles lay flat against the sheets moving thereunder. This orientation provides the necessary flexibility of the bristles in the machine direction and the desired rigidity against deflection in the cross machine direction. As indicated previously, the stiffness of the brush may be reduced by selectively removing bristles from the holder 24. Conveniently, bristle removal may be effected by simply breaking the bristles off where the base of the bristle joins the holder.

A brush containing pultruded bristles 25 of the present invention was loaded and run against a corrugated paperboard surface attached to a cylindrical roll and including a raised paperboard piece to simulate a shingle of sheets. The brush was run over the equivalent of 600 miles of corrugated paperboard. The bristles did not take a set and showed no sign of wear. The test run was equivalent to more than 5 weeks of continuous operation. Comparably sized nylon bristles, subjected to a static bending load, took a set after only 5 hours.

Figure 8:
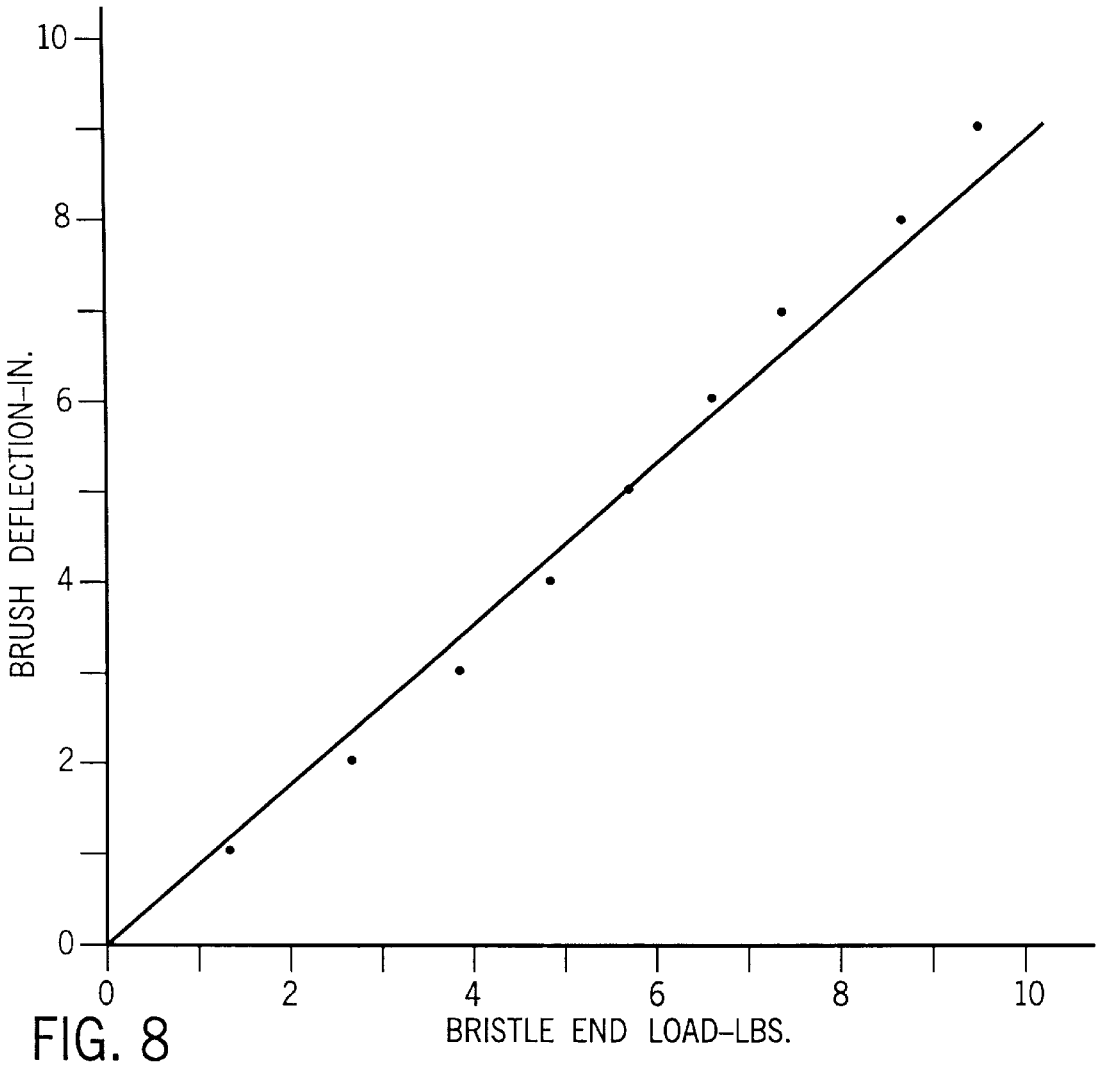
FIG. 8 is a graph of the response under load of a brush section made with the bristles of the subject invention.

The larger rectangular section bristles of course have a bending modulus which is substantially greater than that of the smaller round section bristles. Bristle selection may thus be tuned to the particular application, considering such things as sheet or board caliper, board length and material, and conveying speed. FIG. 8 is a graph which shows the plot of the force necessary to uniformly bend all the bristles of a brush section 23. The brush section tested was 11.38 inches (about 289 mm) wide and utilized bristles 17 inches (about 430 mm) long. The bristles were of rectangular section 31 as shown in FIG. 5. As shown in FIG. 8, the flexural response of the brush section 23 under load is nearly linear.

We claim:

1. A deformation resistant brush assembly for use in a sheet handling system to assist in serially decelerating sheets being conveyed in a line onto a conveyor operating at a speed less than the speed of the line, said brush assembly comprising:

a series of laterally aligned parallel bristles attached at one end to a common holder;

a mounting device supporting the holder over the conveyor with the free ends of the bristles extending in a generally downstream direction and operable to cause the free ends of the bristles to bear downwardly against the sheets with a force sufficient to bend the bristles;

said bristles having a length at least as long as the distance between the mounting device and the conveyor, and having a pultruded construction which resists the formation of a permanent set from said bend over the full bristle wear life.

2. The brush assembly as set forth in claim 1 wherein the bristles are circular in cross section and have a length to diameter ratio in the range of 200 to 300.

3. The brush assembly as set forth in claim 1 wherein the bristles are rectangular in cross section and are mounted in the holder with the longer cross sectional dimensions laterally disposed.

4. The brush assembly as set forth in claim 3 wherein the bending deflection of the ends of the bristles in the brush assembly under a load applied to the free ends of the bristles is approximatley linear.

5. The brush assembly as set forth in claim 1 wherein said bristles are cut from a continuous fiber pultrusion having a fiberglass core impregnated and coated with a thermosetting resin.

6. The brush assembly as set forth in claim 5 wherein said resin comprises a polyester resin.

7. The brush assembly as set forth in claim 1 wherein said mounting device is adjustable to vary the downward forces imposed on the sheets by the bristles.

* * * * *